US006819288B2

(12) United States Patent
Truthan

(10) Patent No.: US 6,819,288 B2
(45) Date of Patent: Nov. 16, 2004

(54) SINGULAR FEED BROADBAND APERTURE COUPLED CIRCULARLY POLARIZED PATCH ANTENNA

(75) Inventor: Robert E. Truthan, Cuyahoga Falls, OH (US)

(73) Assignee: Allen Telecom LLC, Orland Park, IL (US)

( * ) Notice: Subject to any disclaimer, the term of this patent is extended or adjusted under 35 U.S.C. 154(b) by 0 days.

(21) Appl. No.: 10/328,585

(22) Filed: Dec. 23, 2002

(65) Prior Publication Data

US 2004/0119642 A1 Jun. 24, 2004

(51) Int. Cl.[7] ..... H01Q 1/38; H01Q 1/24
(52) U.S. Cl. ..... 343/700 MS; 343/702
(58) Field of Search ..... 343/700 MS, 702, 343/767, 770, 778, 768

(56) References Cited

U.S. PATENT DOCUMENTS

| | | | | |
|---|---|---|---|---|
| 4,475,107 | A | | 10/1984 | Makimoto et al. |
| 4,564,842 | A | | 1/1986 | Suzuki |
| 4,929,959 | A | * | 5/1990 | Sorbello et al. ..... 343/700 MS |
| 5,241,321 | A | | 8/1993 | Tsao |
| 5,243,353 | A | | 9/1993 | Nakahara et al. |
| 5,355,143 | A | * | 10/1994 | Zurcher et al. ..... 343/700 MS |
| 5,410,322 | A | | 4/1995 | Sonoda |
| 5,703,601 | A | | 12/1997 | Nalbandian et al. |
| 5,861,848 | A | | 1/1999 | Iwasaki |
| 6,124,829 | A | | 9/2000 | Iwasaki |
| 6,140,968 | A | | 10/2000 | Kawahata et al. |
| 6,163,306 | A | | 12/2000 | Nakamura et al. |
| 6,166,692 | A | | 12/2000 | Nalbandian et al. |
| 6,181,281 | B1 | | 1/2001 | Desclos et al. |
| 6,239,750 | B1 | * | 5/2001 | Snygg ..... 343/700 MS |
| 6,262,683 | B1 | | 7/2001 | Kawahata et al. |
| 6,326,923 | B2 | | 12/2001 | Shigihara |
| 6,392,602 | B2 | | 5/2002 | Kawahata et al. |
| 6,396,442 | B1 | | 5/2002 | Kawahata et al. |

* cited by examiner

*Primary Examiner*—James Vannucci
(74) *Attorney, Agent, or Firm*—Michael Best & Friedrich LLP

(57) ABSTRACT

Disclosed is an antenna and a method of transmitting and receiving broadband circularly polarized signals. The antenna includes a substrate that has a first surface and an opposing second surface, and a first conductive element that is positioned at the first surface of the substrate. The first conductive element defines an aperture therein the first surface of the substrate. The antenna also includes a conductive strip positioned at the opposing second surface of the substrate. The conductive strip is electrically isolated from the aperture by the substrate therebetween, and, provides a transmission line that generates electromagnetic coupling with the aperture. Further, the antenna has a symmetric conductive element in the form of a planar polygon that is positioned relative to the aperture for broadband coupling of electromagnetic radiation. Furthermore, the opposing corners that are formed on the symmetric conductive element are configured to induce phase quadrature.

42 Claims, 4 Drawing Sheets

SINGULAR FEED BROADBAND APERTURE COUPLED CIRCULARLY POLARIZED PATCH ANTENNA

BACKGROUND OF THE INVENTION

The present invention relates to patch antennas, and more particularly to antennas using aperture coupling with symmetric conductive elements to generate circular polarization.

Typical aperture coupled patch antenna technology has most often been used in the defense and aerospace industries. However, aperture coupled patch antennas have recently been applied in low cost commercial applications such as global positioning satellites, paging, cellular communication, personal communication systems, global systems for mobile communication, wireless local area networks, cellular video broadcasting, direct broadcast satellites, automatic toll collection, collision avoidance radar, and wide area computer networks.

Aperture coupled patch antennas are generally designed to broaden the bandwidth of the operational input impedance to support the broader band services of cellular 800/900 MHz and personal communication systems ("PCS") 1800/1900 MHz bands. These services incorporate the use of linearly polarized patch antenna arrays at the base stations and, in some configurations, in mobile or vehicular applications.

An exemplary aperture coupled microwave antenna is shown in U.S. Pat. No. 5,241,321 for "Dual Frequency Circularly Polarized Microwave Antenna" to Tsao issued Aug. 31, 1993. Tsao discloses an antenna capable of generating circularly polarized signals. The antenna requires a dual feed approach to augment operation at two separate frequencies to achieve a "dual frequency" mode antenna. The geometry places the feeds orthogonal to each other and each electromagnetically couples the aperture through the crossed slots. The crossed slots are essentially isolated electrically from each other so as not to interfere with one another. The antenna thus is an aperture fed patch via electromagnetic coupling from the feed circuits/aperture design. However, the square patch element requires the incorporation of tuning stubs for adjusting for optimal circularity of the polarization at each desired frequency. The conductive tuning stubs attached to the sides of the patch are operable to induce a 90 degree phase separation between dual linearly polarized signals to convert them into a circularly polarized signal. The stubs are either inductive or capacitive. Specifically, to achieve circular polarization, the antenna requires that the tuning stubs be directly attached to the patch element to convert two linearly polarized frequencies to a circular polarization. The tuning stubs thus require complex implementation and adjustment to accomplish circular polarization. The antenna also requires multiple dielectric layers, complicated feeding networks, and multiple ground layers to achieve certain characteristics.

Similarly, other antennas are structured and designed to achieve broad band coupling and circular polarization. For example, the antenna disclosed in U.S. Pat. No. 6,396,442 to Kawahata et al "Circularly Polarized Antenna Device and Radio Communication Apparatus Using the Same" issued May 28, 2002 discloses a circularly polarized antenna for a radio communication apparatus. The antenna includes a dielectric base, an electrode, feeder electrodes, and a feeder circuit board. Specifically, the antenna requires a complex feeding network, and four feeder electrodes in one embodiment, to achieve circular polarity. The complex feeding network requires complex implementation. The feeder electrodes further increase the difficulties in implementing such an antenna.

Still another antenna is disclosed in U.S. Pat. No. 6,166,692 to Nalbandian et al for "Planar Single Feed Circularly Polarized Microstrip Antenna with Enhanced Bandwidth" issued Dec. 26, 2000. Nalbandian et al teaches a planar single feed circularly polarized microstrip antenna, which requires a multiple layer arrangement. In one embodiment, the antenna is formed by two layered cavities with two rectangular conductive patches. The antenna, similarly to the previously disclosed antennas, uses multiple layers and complicated feed networks to achieve circular polarization. While attempting to provide the desired low profile configuration and wide bandwidth, the antenna still require complicated structure and multiple layers thereby increasing the implementation difficulties.

As described, most of the aperture coupling work involves broad banding or dual banding the antennas to achieve specific performance goals for linear polarized patch configurations. Complex arrangements of coupling apertures and quadrature feed networks (polarizers) are often incorporated to generate orthogonal phasing to accomplish circular polarization. Furthermore, degradation occurs in the axial ratio or the radiation pattern when aperture coupling through a slot is used, and the corresponding gain also suffers when polarizers or other hybrid combining feed networks are utilized, which also leads to unnecessary feed loss.

Some of these antennas also incorporate offset fed square or circular patch elements, "almost square" patches, slotted patches, crossed slot apertures, orthogonal coupling slots fed with quadrature feed, crossed slot within multiple layers and offset fed mitered patches. A substantial drawback associated with these designs is that they require either careful alignment or placement of the feed probe or the feed networks for proper coupling and circular polarization. Additionally, such designs are further limited in impedance or axial ratio bandwidth. While stacked patches or multiple layers are shown to achieve broad bandwidth, they fail to maintain a broad banded (i.e. >5%) axial ratio.

SUMMARY OF THE INVENTION

Accordingly, there is a need for an improved method and apparatus of transmitting and receiving broadcast signals with an antenna. Further, it would be beneficial to increase signal bandwidth percentage, to broaden signal bandwidth, to improve an axial ratio and a phase separation, and to optimize polarization of an antenna.

Consequently, the present invention provides a system of transmitting and receiving signals. In one embodiment, the invention provides an antenna that includes a substrate that has a first surface and an opposing second surface, and a first conductive element that is positioned at the first surface of the substrate. The first conductive element defines an aperture therein at the first surface of the substrate. The antenna also includes a conductive strip positioned at the opposing second surface of the substrate. The conductive strip is electrically isolated from the aperture by the substrate therebetween, and provides a transmission line that generates electromagnetic coupling with the aperture. Further, the antenna has a symmetric conductive element in the form of a planar polygon that is positioned relative to the aperture for broadband coupling of electromagnetic radiation. In addition, the opposing corners that are formed on the symmetric conductive element are configured to induce quadrature phasing.

In another embodiment, the present invention provides a method of radiating circularly polarized signals. The method includes providing a substrate that has a first surface and an opposing second surface, and positioning a first conductive element at the first surface of the substrate, wherein the conductive element defines an aperture. The method also includes positioning a conductive strip at the opposing second surface of the substrate, wherein the conductive strip is electrically isolated from the aperture by the substrate therebetween, and provides a transmission line that generates electromagnetic coupling with the aperture. Furthermore, the method includes positioning a symmetric conductive element relative to the aperture for broadband electromagnetic coupling and radiation. The symmetric conductive element is in the form of a planar polygon. The method also includes forming opposing corners on the symmetric conductive element wherein the opposing corners are configured to induce quadrature phasing, and feeding the conductive strip with a signal.

Briefly summarized, the invention provides a patch antenna structure including an aperture, a conductive strip and a symmetric conductive element to achieve circular polarization. The symmetric conductive element is spaced relative to the conductive strip, and the symmetric conductive element and the conductive strip are electromagnetically coupled through the aperture. The antenna also includes a first conductive element that defines the aperture therein at the first surface of the substrate. The conductive strip is positioned at an opposing second surface of the substrate. The conductive strip is electrically isolated from the aperture by the substrate therebetween, and, provides a transmission line that generates electromagnetic coupling with the aperture. Further, the symmetric conductive element is in the form of a planar polygon, and is positioned relative to the aperture and the conductive strip for broadband coupling of electromagnetic radiation. The antenna thus achieves optimal performance for gain, axial ratio and input impedance over relatively large bandwidth.

Other features and advantages of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION OF THE PREFERRED EMBODIMENTS

Figure 1:
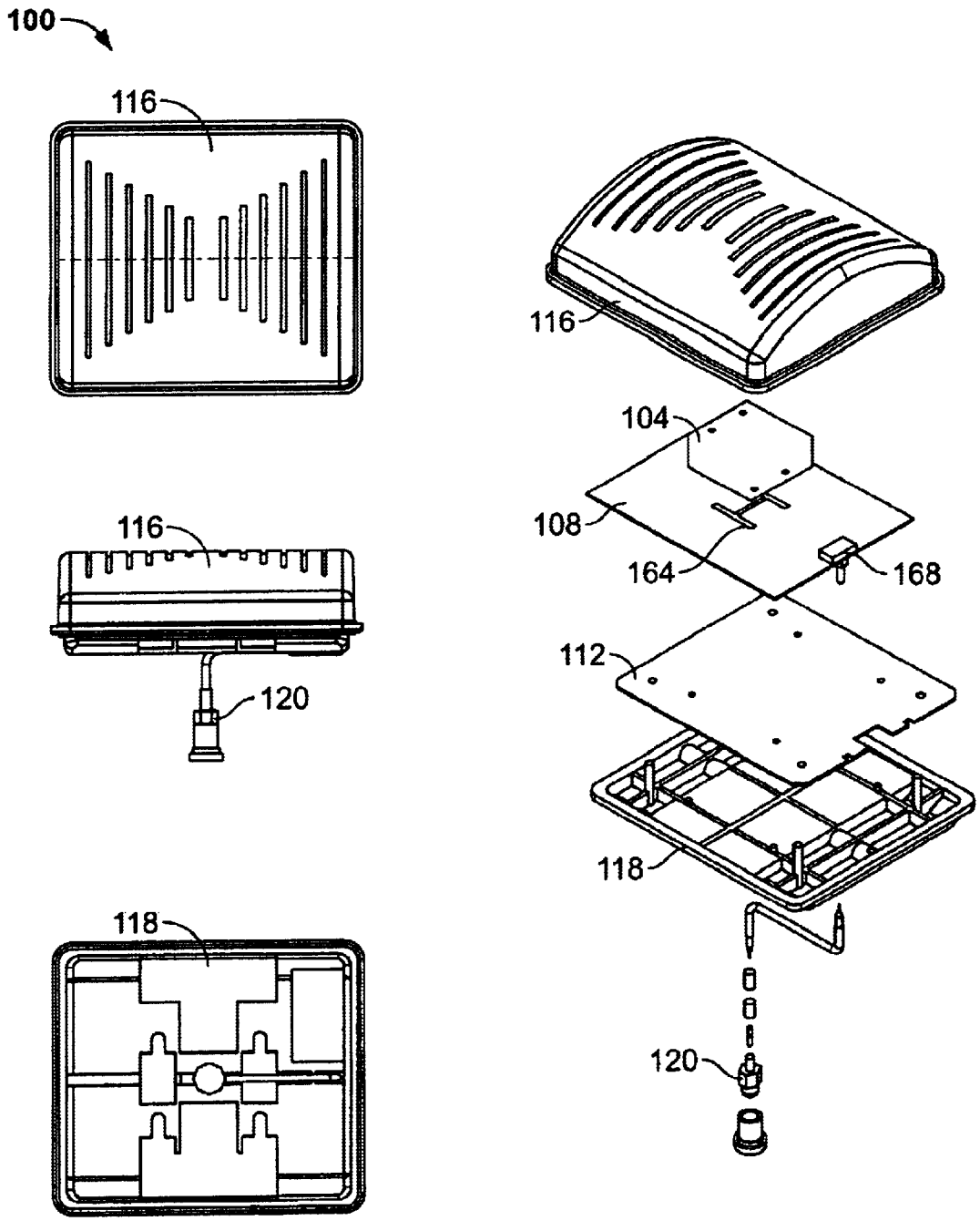
FIG. 1 is an exploded perspective view of an embodiment of an antenna according to the present invention.

FIG. 1 shows an exploded perspective view of an embodiment of an antenna 100 according to the present invention. The antenna 100 includes a symmetric conductive element or a symmetric radiating patch 104 in the form of a planar polygon that is positioned over a substrate 108. The substrate 108 is further suspended over a backplate 112. The antenna 100 is enclosed in a radome top 116 and a radome bottom 118, and can be connected to other devices with an external coaxial connector 120.

Figure 2:
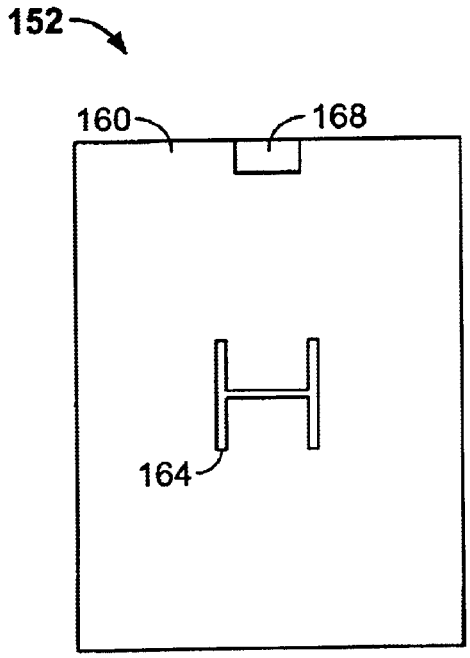
FIG. 2 is a first surface of a substrate of the antenna of FIG. 1.

Specifically, the substrate 108 has a first surface 152 as illustrated in FIG. 2. The substrate 108 is preferably a modified printed circuit board laminate. A first conductive element 160 is positioned at the first surface 152. The first conductive element 160 further includes an aperture 164. The aperture 164 is symmetric, and has an essentially "H" shape. Other suitable aperture shapes with enlarged extension geometry may include bow tie, dog bone, and the like. The first conductive element 160 is preferably copper, but other conductive material can also be used. Also, the first surface has a substrate connector 168 that is configured to provide connection between the first surface 152, other devices or surfaces.

Figure 3:
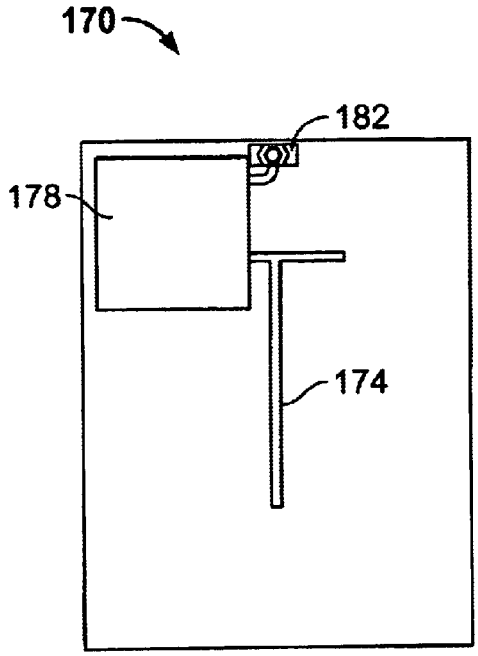
FIG. 3 is an opposing second surface of the substrate of the antenna of FIG. 1.

Furthermore, the substrate 108 has an opposing second surface 170 as illustrated in FIG. 3. As with the first surface 152, a conductive strip 174 is positioned at the opposing second surface 170. The conductive strip 174 is essentially electrically isolated from the aperture 164 by the substrate 108. The conductive strip 174 in turn provides a transmission line that generates electromagnetic coupling for a given frequency band with the aperture 164. More specifically, the conductive strip provides an open circuit termination that extends beyond the aperture 164 on the opposing second surface 170. The open circuit termination also induces a capacitance that resonates with the aperture 164. The conductive strip is electrically isolated from the aperture by the substrate therebetween, and, providing a transmission line that generates electromagnetic coupling with the aperture. Further, the antenna has a symmetric conductive element in the form of a planar polygon that is positioned relative to the aperture for broadband electromagnetic radiation. In addition, the opposing corners that are formed on the symmetric conductive element are configured to phase quadrature. More specifically, the conductive strip 174 is essentially a "T" shape copper strip that defines a 50 Ohm transmission line. To match impedance of the aperture 164, a midpoint along the length of the conductive strip 174 is configured to be coincident with a center of the aperture 164. If the antenna 100 is configured to receive signals, an optional low noise amplifier 178 can be also coupled to the conductive strip 174 and a cable connector 182 that connects to the substrate connector 168. Therefore, the cable connector 182 provides a connection from which an amplified reception is output.

Figure 4:
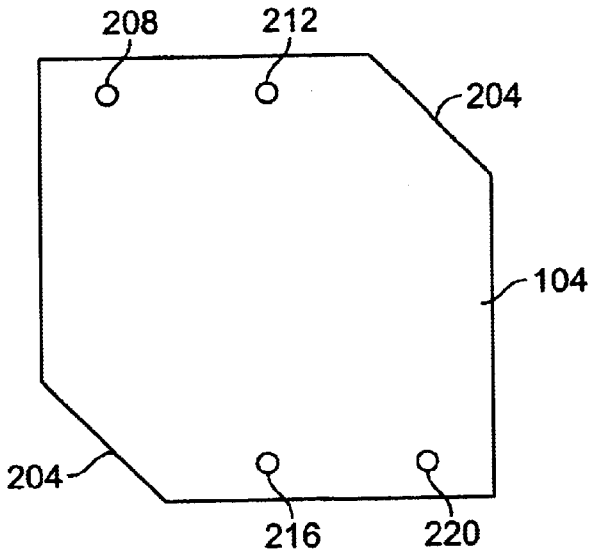
FIG. 4 is a top view of a symmetric conductive element of the antenna of FIG. 1.

The symmetric conductive element 104, as shown in FIG. 4, can be obtained from mitering two opposite corners of an essentially square shaped conductive element or an essentially square patch that is properly sized. Specifically, a square patch with a single conductive strip feeding system generally radiates linear polarization. To radiate circular polarization, two orthogonal patch modes with equal amplitude and phase quadrature are induced by mitering two opposing corners of an essentially square patch. More specifically, the electromagnetic fields of the mitered square patch can be separated into two orthogonal modes. If an essentially square patch is mitered properly to form two diagonally opposing corners, or if a symmetric radiating patch is dimensionally sized, the patch will have a first operating mode and a second operating mode. Both modes will have substantially the same magnitude response operating at the same resonant frequency. However, the phase response corresponding to the first operating mode is separated from the phase response corresponding to the second operating mode by 90° at their respective peak magnitudes. The 90° out of phase separation, or phase quadrature is optimal, hence resulting in a best axial ratio.

As a result, the symmetric conductive element 104 is dimensionally sized to optimize the resonant frequency and to generate two orthogonal operating modes. In the case of mitering two opposing corners from an essentially square patch, the patch is approximately 1.81"×1.81" and 0.02" thick. The corners are mitered at 0.5" from the patch corners. The substrate 108 is approximately 2.9"×3.9" and 0.03" thick. The essentially "H" shaped aperture 164 is approximately 0.79"×0.83", with the vertical apertures being 0.08" wide, and the horizontal aperture being 0.06" wide. Further, the conductive strip 174 includes a 0.07"×2.79" vertical strip and a 0.59" horizontal strip that has normal distance of 1" from the center of the aperture 164. It would be apparent to one of ordinary skill in the art that if any of the parameters is changed, the others have to be adjusted as well to continue to achieve optimal broadband coupling at the aperture 164. The two orthogonal operating modes induce a phase quadrature or a 90 degree phase separation between modes, while maintaining equivalent amplitude. Further, an optimized phase quadrature occurs at a center resonant frequency, and degrades above and below the center resonant frequency. Furthermore, the symmetric conductive element 104 is configured to provide left-hand circular polarization. However, when the symmetric conductive element 104 is flipped over face to face, the flipped symmetric conductive element 104 reverses the polarization from one sense to an opposite sense, the symmetric conductive element 104 can now be used for right-hand circular polarization.

The symmetric conductive element 104 is preferably a highly conductive solid metallic material such as 260 half-hard brass. Other metallic or conductive materials also suitable for building the symmetric conductive element 104 include aluminum, copper, silver, plated steel, and the like. The symmetric conductive element 104 also includes a plurality of securing holes 208, 212, 216, 220 allowing the symmetric conductive element 104 to be suspended from the top of the interior of the radome top 116 using a plurality of positioning pegs. If the antenna 100 is configured to provide both left hand circular polarization and right hand circular polarization, the symmetric conductive element 104 can be secured using a pair of rotatable pivots near the holes 212 and 216. In this way, the symmetric conductive element 104 can be flipped along the rotatable pivots with relative ease.

Furthermore, referring back to FIG. 1, the aperture 164 is configured to broad band couple to the symmetric conductive element 104 such that when both the symmetric conductive element 104 and the aperture 164 are properly dimensioned, the result is a broad band circular polarized antenna 100. Specifically, the aperture 164 is positioned such that the center of the aperture 164 and the center of the symmetric conductive element 104 are coincident. The aperture 164 is also substantially spaced apart from the symmetric conductive element 104. More specifically, the aperture 164 is substantially centered near the center of the symmetric conductive element 104 where the magnetic field of the symmetric conductive element 104 is essentially the strongest. Further, the aperture 164 also interrupts both the induced current flow in the symmetric conductive element 104 and the current flow in the conductive strip 174. Therefore, a coupling of the aperture 164 to the symmetric conductive element 104 and the conductive strip 174 occurs. Furthermore, the essential coincidence of the centers also improves the magnetic coupling between the magnetic field generated by the symmetric conductive element 104 and the magnetic current near the aperture 164.

The spacing between the aperture 164 and the symmetric conductive element 104 is approximately 0.4". However, it would be apparent to those skilled in the art that the spacing can be less than or more than 0.4" depending on the desired antenna characteristics and the dielectric chosen. More specifically, the symmetric conductive element 104 is positioned relative to the conductive strip 174 such that optimized broadband coupling of the electromagnetic radiation can occur through the aperture 164.

Alternatively, the aperture 164 can also support linear polarization configurations within the same operation frequency band. For example, once a set of preferred linear symmetric conductive element dimensions are determined, simple aperture modifications can be performed to match the linear polarized antenna over the identical frequency band of the circular polarized configuration.

The combination of the aperture 164, the conductive strip 174 and the symmetric conductive element 104 generates broad bandwidth circular polarized signals for the antenna 100. The embodiment shown in FIG. 1, for example, provides an approximately 8.4% operational bandwidth with a frequency band between about 2225 MHz and about 2425 MHz. The antenna 100 also provides an approximately 2:1 voltage standing wave ratio ("VSWR"), a nominal gain of about 7 dBic, and a peak gain of about 8 dBic. The antenna 100 further generates a nominal axial ratio of approximately 1.5 dB, a maximum axial ratio of approximately 3 dB, a cross polarization of about 8 to 12 dB, an average cross polarization value of about 10 dB, and a front-to-back ratio of more than 17 dB.

The back plane 112 in the antenna 100 is a reflective brass or any metallic reflector located below the substrate 108. The back plane 112 functions to reflect stray signals that are leaking off from the conductive strip 174 or leaking back from other possible antenna mismatches. The back plane 112 also reduces backward radiation, either from the conductive strip 174 or the aperture 124.

When the antenna 100 is used as a transmitter, signals are first fed from a transmitting radio frequency ("RF") source, via the external coaxial connector 120. The connector 120 first transitions a 50-Ohm coaxial transmission line onto the conductive strip 174. The first conductive element 160 then acts as the ground plane for the transmission operation. As the signal travels down the conductive strip 174, an open circuit termination or an electrical quarter-wave is located prior to the aperture 164. When signals are fed to the symmetric conductive element 104 through the aperture 164, the open circuit termination matches the impedance of the aperture 164 and the symmetric conductive element 104 combination. Specifically, as described earlier, when the conductive strip 174 is extended beyond the aperture 164, the open circuit configuration is formed and a capacitance is induced. As a result, the induced capacitance will resonate with the aperture 164, which is inductive in practice. The orthogonal modes are then generated on the symmetric conductive element 104. Thereafter, the symmetric conductive element 104 radiates the signals into free space.

When the antenna 100 is used as a receiver, a reciprocal performance or a reverse transmission can generally be achieved. Furthermore, if a unidirectional amplifier such as the amplifier 178 is incorporated in the antenna 100 within the conductive strip 174 on the opposing second surface, the antenna 100 is only configured to receiving signals. Otherwise, the antenna 100 can be used both as a receiver and a transmitter, or a transceiver.

Figure 5:
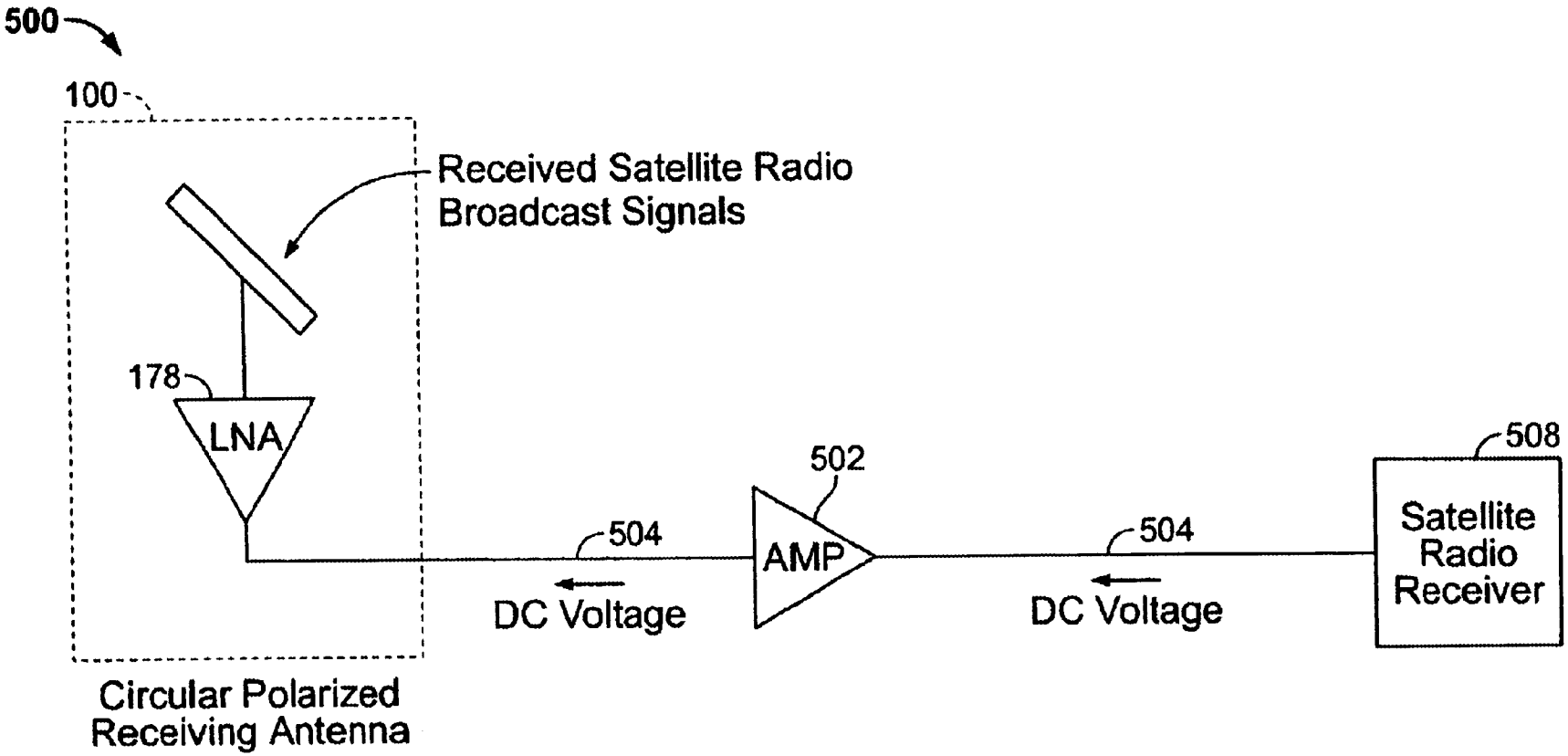
FIG. 5 shows an exemplary block diagram of a satellite digital audio radio service ("SDARS") reception using the antenna of FIG. 1.

The antenna 100 is also configured to provide satellite digital audio radio services ("SDARS") in a satellite system. For example, a direct receiver connection version or system 500 (shown in FIG. 5) utilizes the antenna 100 as a receiver only, fixed location antenna. Additional low noise amplifiers (LNAs) are required only if the transmission lines lengths exceed attenuation limits of the system 500. The antenna 100 is first mounted in an appropriate direction to receive incident signals from a satellite. The LNA 178 then performs an initial signal amplification of the received satellite signals. The signals are thereafter fed to an optional amplifier 502 through typical coaxial cables 504 for optional amplification to compensate for the loss of signal strength due to the length of the coaxial cable 504. A satellite receiver 508 generally provides the direct current ("dc") power to the system 500. However, other external power devices can also be used to provide power to the system 100.

Figure 6:
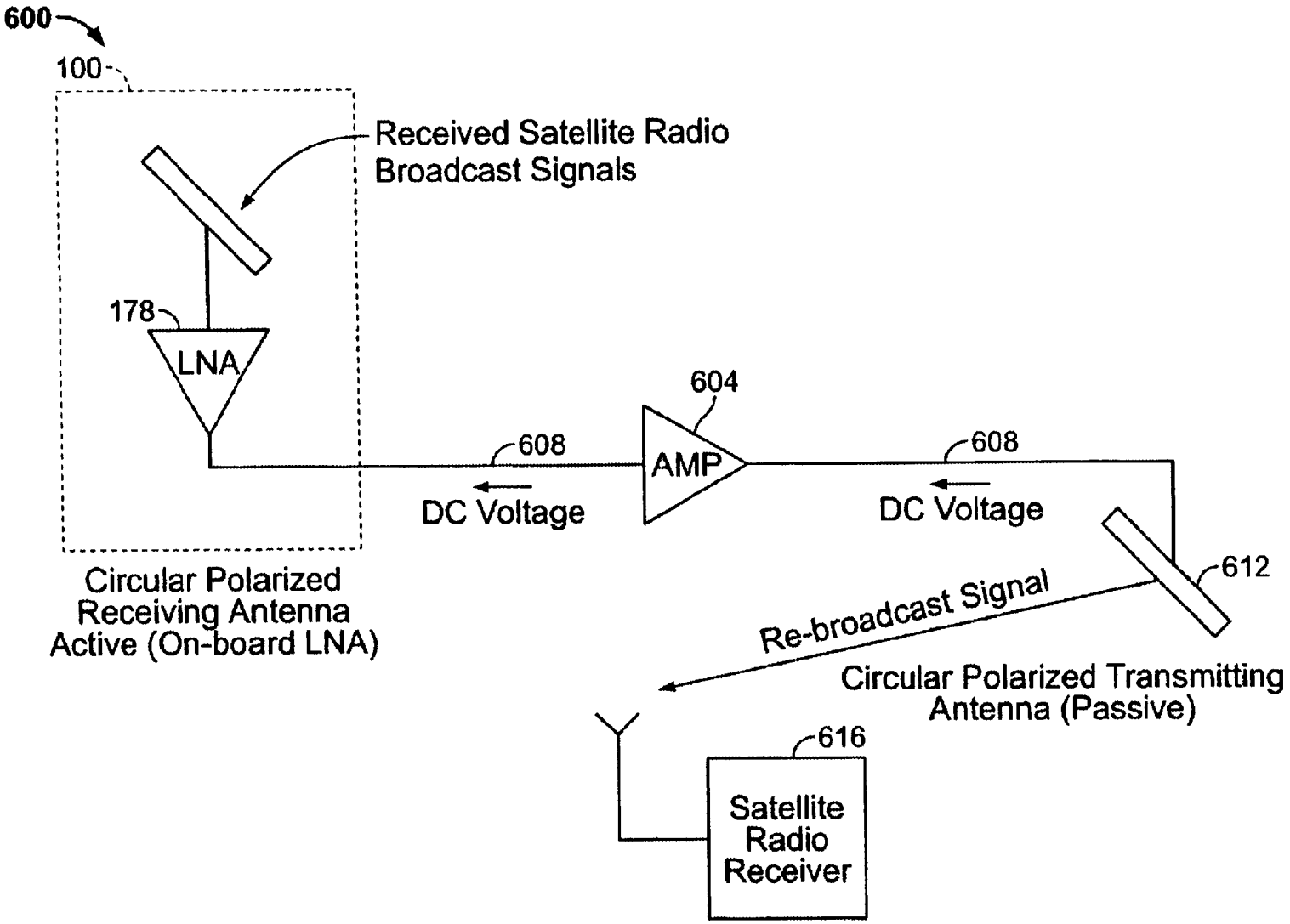
FIG. 6 shows an exemplary block diagram of SDARS reception and rebroadcast system using the antenna of FIG. 1.

The antenna 100 can also be used in a wireless rebroadcast system 600, as shown in FIG. 6. The wireless rebroadcast system 600 uses the antenna 100 as an active receiving antenna. The system 600 uses a passive version of the antenna 100 for re-transmission of signals to provide coverage within a blocked area, such as within an indoor environment. Specifically, similar to the system 500, after the incident signals have been received at the antenna 100, the signals are amplified by the LNA 172. The amplified signals then reaches an optional amplifier 604 via some coaxial cable 608. The twice amplified signals are thereafter rebroadcast using a second antenna 612 (the passive version of the antenna 100) to a satellite radio receiver 616. An external power device located between the passive antenna 612 and the optional amplifier 604 generally powers the system 600.

Various features and advantages of the invention are set forth in the following claims. While the present invention has been illustrated by a description of various embodiments and while these embodiments have been set forth in considerable detail, it is intended that the scope of the invention be defined by the appended claims. It will be appreciated by those skilled in the art that modifications to the foregoing preferred embodiments may be made in various aspects. It is deemed that the spirit and scope of the invention encompass such variations to the preferred embodiments as would be apparent to one of ordinary skill in the art and familiar with the teachings of the present application.

What is claimed is:

1. An antenna comprising:

a substrate having a first surface and an opposing second surface;

a first conductive element positioned at the first surface of said substrate, the first conductive element defining an aperture therein;

a single conductive strip positioned at the opposing second surface of said substrate, the single conductive strip being electrically isolated from the aperture by said substrate therebetween, and, providing a transmission line coupling with the aperture to cooperatively generate polarizable electric and magnetic currents in the proximity of the aperture;

a symmetric conductive element formed from mitering two opposite corners of an essentially square shaped conductive element, positioned relative to the aperture for broadband coupling of electromagnetic radiation coupled from the single conductive strip; and opposing corners formed on said symmetric conductive element being configured to induce phase quadrature to obtain large bandwidth axial ratio performance.

2. The antenna of claim 1, wherein the substrate comprises modified printed circuit board laminate, the first conductive element comprises copper, and the conductive strip comprises copper.

3. The antenna of claim 1, wherein the aperture comprises essentially an "H" shaped aperture, the aperture broadhandedly coupling to the symmetric conductive element.

4. The antenna of claim 1, wherein the opposing corners formed on said symmetric conductive element comprise diagonally opposing corners.

5. The antenna of claim 1, wherein the symmetric conductive element is coupled electrically and supported in an air dielectric substrate.

6. The antenna of claim 1, wherein the symmetric conductive element comprises a first center, the aperture comprises a second center, and the first center being coincident with the second center.

7. The antenna of claim 1, further comprising a plurality of positioning pegs, the positioning pegs suspending the symmetric conductive element over the aperture.

8. The antenna of claim 1, wherein the conductive strip further comprises an open circuit termination, the open circuit termination extending beyond the aperture on the opposing surface.

9. The antenna of claim 8, wherein the open circuit termination induces a capacitance, the capacitance resonating with the aperture.

10. The antenna of claim 1, wherein the symmetric conductive element comprises a square patch with at least two diagonally opposing mitered corners, the square patch with mitered corners optimizing a resonant frequency.

11. The antenna of claim 10, wherein the square patch with mitered corners further generates two orthogonal modes.

12. The antenna of claim 1, wherein the conductive strip further comprises an open circuit stub for impedance matching the aperture and the substrate.

13. The antenna of claim 1, wherein the symmetric conductive element is configured to generate circular polarization.

14. The antenna of claim 1, wherein the symmetric conductive element comprises 260 half hard brass.

15. The antenna of claim 1, wherein the conductive strip comprises an essentially "T" shape transmission line.

16. A method of radiating circularly polarized signals, the method comprising:

providing a substrate, the substrate having a first surface and an opposing second surface;

positioning a first conductive element at the first surface of said substrate, the conductive element defining an aperture therein;

positioning a single conductive strip at the opposing second surface of said substrate, the single conductive strip being electrically isolated from the aperture by said substrate therebetween, and, providing a transmission line coupling with the aperture to cooperatively generate polarizable electric and magnetic currents in the proximity of the aperture;

positioning a symmetric conductive element relative to the aperture for broadband coupling of electromagnetic radiation, the symmetric conductive element being formed from mitering two opposite corners of an essentially square shaped conductive element;

forming opposing corners on said symmetric conductive element, the opposing corners being configured to induce phase quadrature to obtain large bandwidth axial ratio performance; and feeding the single conductive strip with a signal.

17. The method of claim 16, further comprising forming an essentially "H" shaped aperture, the aperture broadbandedly coupling to the symmetric conductive element.

18. The method of claim 16, further comprising forming the opposing corners on said symmetric conductive element diagonally.

19. The method of claim 16, further comprising an air dielectric substrate for the symmetric conductive element.

20. The method of claim 16, further comprising suspending the symmetric conductive element over the aperture.

21. The method of claim 20, wherein the symmetric conductive element comprises a first center, and the aperture comprises a second center, further comprising coinciding the first center with the second center.

22. The method of claim 16, further comprising extending the conductive strip beyond the aperture on the opposing surface.

23. The method of claim 16, further comprising matching an impedance of the aperture and the substrate.

24. The method of claim 16, further comprising generating orthogonal modes at the opposing corners.

25. The method of claim 16, further comprising optimizing the resonant frequency at the opposing corners.

26. The method of claim 16, further comprising inducing phase quadrature at the symmetric conductive element.

27. The method of claim 16, wherein the aperture induces an induction, further comprising capacitively resonating at the symmetric conductive element with the inductive aperture.

28. An antenna comprising:

a conductive element, the conductive element defining an aperture therein;

a single conductive strip positioned below the conductive element, the single conductive strip being electrically isolated from the aperture and providing a transmission line coupling with the aperture to cooperatively generate polarizable electric and magnetic currents in the proximity of the aperture;

a symmetric conductive element formed from mitering two opposite corners of an essentially square shaped conductive element, positioned above the aperture for electromagnetically coupling with the single conductive strip and the symmetric conductive element through the aperture; and opposing corners formed on said symmetric conductive element being configured to induce phase separation to obtain large bandwidth axial ratio performance.

29. The antenna of claim 28, further comprising a dielectric substrate positioned between the conductive element and the conductive strip.

30. The antenna of claim 29, wherein the substrate comprises modified-printed circuit board laminate, the conductive element comprises copper, and the conductive strip comprises copper.

31. The antenna of claim 28, wherein the aperture comprises essentially an "H" shaped aperture.

32. The antenna of claim 28, wherein the opposing corners formed on said symmetric conductive element comprise diagonally opposing corners.

33. The antenna of claim 28, wherein the symmetric conductive element comprises an air dielectric element.

34. The antenna of claim 28, wherein the symmetric conductive element comprises a first center, the aperture comprises a second center, and the first center being coincident with the second center.

35. The antenna of claim 28, wherein the conductive strip further comprises an open circuit termination, the open circuit termination extending beyond the aperture on the opposing surface.

36. The antenna of claim 28, wherein the open circuit termination induces a capacitance, the capacitance resonating with the aperture.

37. The antenna of claim 28, wherein the symmetric conductive element comprises a square patch with at least two diagonally opposing mitered corners, the square patch with mitered corners optimizing a resonant frequency.

38. The antenna of claim 37, wherein the square patch with mitered corners further generates two orthogonal modes.

39. The antenna of claim 28, wherein the conductive strip further comprises an open circuit stub for impedance matching the aperture and the conductive strip.

40. The antenna of claim 28, wherein the symmetric conductive element is configured to generate circular polarization.

41. The antenna of claim 28, wherein the symmetric conductive element comprises 260 half hard brass.

42. The antenna of claim 28, wherein the conductive strip comprises an essentially "T" shape transmission line.

* * * * *